United States Patent [19]

Wildey

[11] Patent Number: 4,917,315

[45] Date of Patent: Apr. 17, 1990

[54] FLARED POCKETS FOR CENTRIFUGAL GRINDERS

[75] Inventor: Allan J. Wildey, Brantford, Canada

[73] Assignee: Amca International Limited, Brantford, Canada

[21] Appl. No.: 908,166

[22] Filed: Sep. 17, 1986

[51] Int. Cl.[4] ..... B02C 19/00

[52] U.S. Cl. ..... 241/275

[58] Field of Search ..... 241/275, 28, 86.1

[56] References Cited

U.S. PATENT DOCUMENTS 4,474,335 10/1984 Wildey ..... 241/275 X

*Primary Examiner*—Mark Rosenbaum

*Attorney, Agent, or Firm*—Sim & McBurney

[57] ABSTRACT

A centrifugal grinder has an internal grinding surface shaped as a surface of revolution, and a rotor mounted within the surface for rotation about the axis of the grinding surface. The rotor defines a generally axial inlet passageway for wood chips to be ground, and at least one pocket extending generally outwardly from the axis of the rotor toward the grinding surface. The pocket is provided with a configuration such that its cross section increases at an increasing rate away from the rotor axis. This encourages the wood chips to orient themselves parallel to the grinding surface, such that they take up such parallel orientation by the time they reach the grinding surface.

13 Claims, 2 Drawing Sheets

FLARED POCKETS FOR CENTRIFUGAL GRINDERS

This invention relates generally to centrifugal grinders of the kind disclosed and claimed in my earlier U.S. Pat. No. 4,474,335, issued Oct. 2, 1984. The present invention relates more particularly to an improvement in the shape of the pocket or pockets provided in the rotor of a centrifugal grinder, along which wood chips and the like pass to be pressed by centrifugal force against the internal grinding surface of the stationary grinding stone.

BACKGROUND OF THIS INVENTION

It is generally appreciated in the wood pulp industry that, when grinding wood chips, it is very desirable to orient the grain of the chips parallel to the stone surface for the actual grinding operation. A typical wood chip may measure about 1"×1", with a thickness of ⅛" to ¼". The grain runs parallel to one of the larger dimensions. When a wood chip is ground by lying against the grinding stone with its largest surface, i.e. with the grain oriented substantially parallel with the surface of the grinding stone, it is more likely whole fibres will be produced, rather than small, broken fibre fragments. Generally speaking, the larger the fibres, the better the quality of the resulting pulp.

GENERAL DESCRIPTION OF THIS INVENTION

The aim of an aspect of this invention is to provide a pocket configuration within the rotor of an internal centrifugal grinder which is such as to promote a parallel chip orientation by the time the chip reaches the grinding surface, i.e. an orientation in which the chip grain extends substantially parallel to the internal grinding surface.

I have discovered that by shaping the pocket or pockets in the rotor in a particular way, the desirable orientation of the chips can be to a large extent achieved. It will be understood that it is not a practical goal to seek the proper orientation of all of the wood chips. Because the chips are oriented in a random fashion initially, it is unlikely that in any given time span a uniform parallel orientation can be achieved for all of the chips. However, I have found that the pocket configuration provided herein allows better than three quarters of typical wood chips to assume, by the time they reach the grinding surface, an orientation in which they are parallel to the grinding surface and to each other.

More particularly, this invention provides an improvement in a centrifugal grinder having an internal grinding surface shaped as a surface of revolution, and a rotor mounted within the surface for rotation about the axis thereof, the rotor defining a generally axial inlet passageway for material to be ground, at least one one pocket extends generally outwardly from the axis of the rotor toward the grinding surface. The improvement comprises the provision of a configuration for the at least one pocket, wherein the cross-section of the pocket increases at an increasing rate away from the rotor axis. More particularly, the differential of the expansion rate of the cross-section of the at least one pocket at its outer limit adjacent the internal grinding surface is at least 8 times as great as the differential of the expansion rate of the cross-section of said at least one pocket at the level corresponding to the surface of the generally axial inlet passageway.

GENERAL DESCRIPTION OF THE DRAWINGS

Three embodiments of this invention are illustrated schematically in the accompanying drawings which show the essential geometry without all of the accessory components, like numerals denoting like parts throughout the several views, and in which.

DETAILED DESCRIPTION OF THE DRAWINGS

Figure 8:
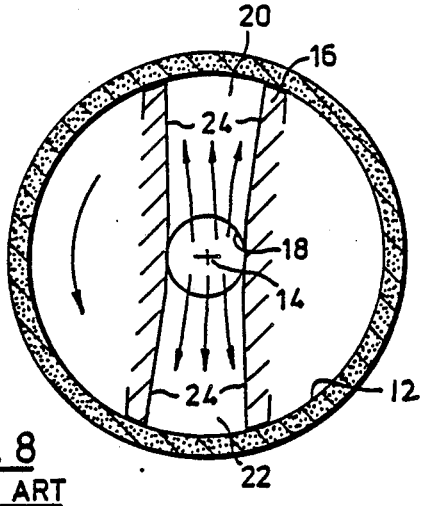
FIG. 8 PRIOR ART
FIG. 8 is a transverse view taken at the line A—A in FIG. 7.
Figure 7:
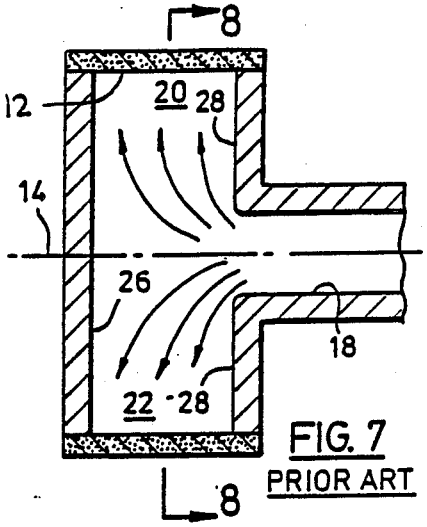
FIG. 7 PRIOR ART
FIG. 7 is a longitudinal sectional view through a prior art construction; p

Attention is first directed to FIGS. 7 and 8, which shows the prior art construction.

In the prior art construction, a grinding stone 10 defines an internal grinding surface 12 shaped as a surface of revolution, and more particularly as a cylinder having an axis shown at the line 14. Looking at FIG. 8, a rotor 16 is provided, the rotor being mounted within the surface 12 for rotation about the axis 14. The rotor 16 defines a generally axial inlet passageway 18 for material such as wood chips to be ground, and two pockets 20 and 22, each extending generally outwardly away from the axis 14 of the rotor and toward the grinding surface 12. In the construction shown in FIGS. 7 and 8, the two pockets 20 and 22 extend in diametrically opposite directions, and are thus spaced at 180° from each other.

It will be noted in FIG. 8 that each pocket 20, 22 is defined between generally rectilinear but slightly diverging walls 24. FIG. 7 shows an axial section at right angles to the section of FIG. 8, also cutting through the pockets 20 and 22. It will be seen that the pockets are defined by parallel walls 26 and 28, transverse to the axis 14.

Figure 9:
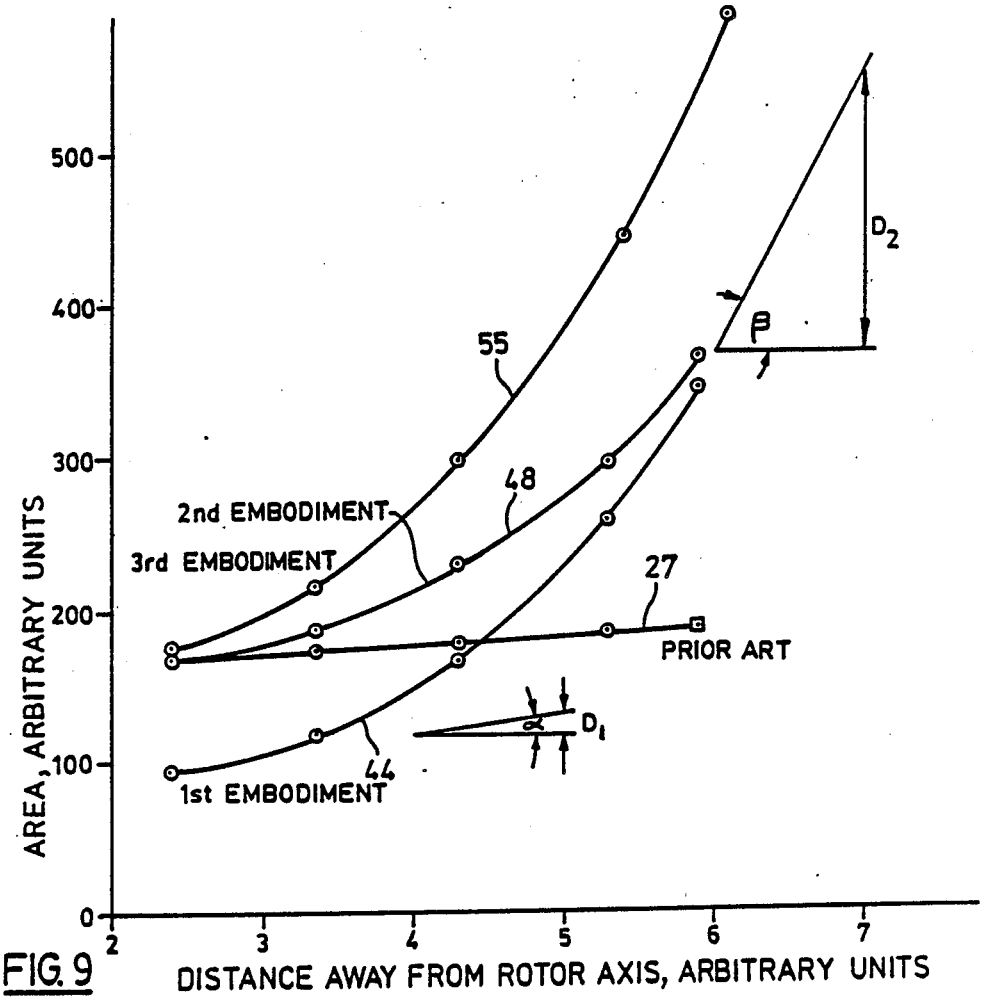
FIG. 9 is a graphical representation of the rates at which the cross-sectional area of a pocket increases away from the axis of the rotor.

If one were to calculate the cross-sectional area of the pockets 20 and 22 by determining, for different radii beginning at the wall of the passageway 18 and ending at the surface 12, the cylindrical surface are a lying within the pockets, the cylinders having the increasing radii, then one would arrive at the line identified by the numeral 27 in FIG. 9, the line being also labelled PRIOR ART. As can be seen, this line is essentially a straight line, due to the fact that the walls of the pockets 20 and 22 are almost parallel in both directions. Because there is a very slight divergence as can be seen in the section of FIG. 8, the cross-sectional area increases slightly in the outward direction, as indicated by the slight upward slope of the line 27 in the graph of FIG. 9.

However, I have determined that a mere divergence by itself is not sufficient to encourage a large-scale re-orientation of the wood chips so that they lie, in the main, parallel to the grinding surface by the time they reach the latter. In order to accomplish this large-scale re-orientation, it is necessary to ensure that the transverse section of the pocket widens at an increasing rate away from the rotor axis, and this is best accomplished by providing a flared configuration as seen in FIGS. 1 through 6.

Figure 2:
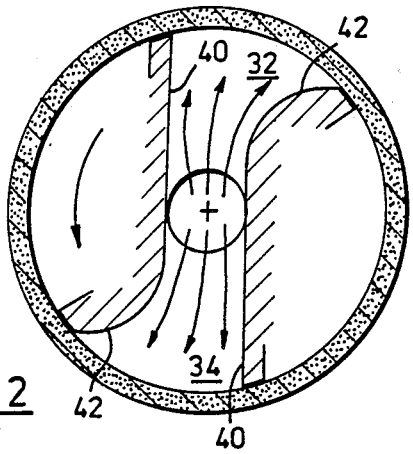
FIG. 2 is a transverse section taken at the line A—A in FIG. 1.
Figure 1:
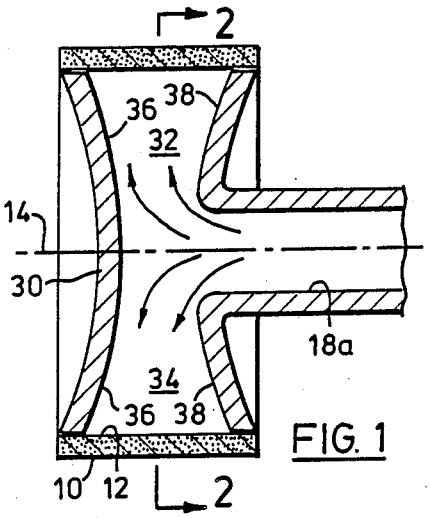
FIG. 1 is a longitudinal section through a first embodiment.

Attention is first directed to FIGS. 1 and 2, illustrating the first embodiment of this invention. As can be seen, in FIG. 1, the grinding stone 10 is again provided with an internal cylindrical grinding surface 12. A rotor 30 is provided, rotatable about the axis 14 of the stone 10, the rotor 30 shaped to define an axial passageway 18*a* which opens into two oppositely extending pockets 32 and 34. As can be seen in FIG. 1, each pocket 32, 34 is defined between walls 36 and 38 which widen at an increasing rate away from the axis 14. The section through the wall 36 is thus a curve, as is the section through the wall 38.

Referring to FIG. 2, the dimension of each pocket 32, 34 in the direction transverse to the section of FIG. 1 also widens at an increasing rate. The pocket 32 is defined between a flat wall 40 and a strongly curved wall 42, and the same is true for the pocket 34. The strongly curved wall 42 in each case is the trailing wall in the sense of rotation, which in the view of FIG. 2 is counter-clockwise.

If one were to utilize the precise geometry shown in FIGS. 1 and 2, and perform the same calculations as were done to arrive at the line 27 in FIG. 9, one would arrive at the line identified by the numeral 44 in FIG. 9, which is also labelled as "lst Embodiment". As can be seen, the slope of the line 44 increases at a progressive rate from the left to the right, which corresponds to increasing distance away from the axis 14. The angle alpha drawn adjacent the line 44 in FIG. 9 represents the slope of the line 44 at the leftward extremity, whereas the angle beta drawn at the upper right in FIG. 9 represents the slope of the line 44 at the rightward extremity. The distance $D_1$ in FIG. 9 is proportional to the tangent of the angle alpha, whereas $D_2$ is proportional to the tangent of the angle beta. It can be seen that $D_2$, in effect a measure of the slope of the line 44 at the rightward end, is at least 8 times as large as $D_1$, which is the slope at the leftward end.

It is pointed out that the curves in FIG. 9 are not measured in any specific units, but are accurate in terms of showing the relative rate of increase of the cross-section away from the axis.

Figure 4:
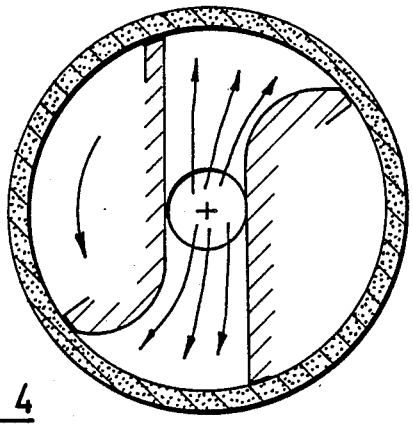
FIG. 4 is a transverse section taken at the line A—A in FIG. 3.
Figure 3:
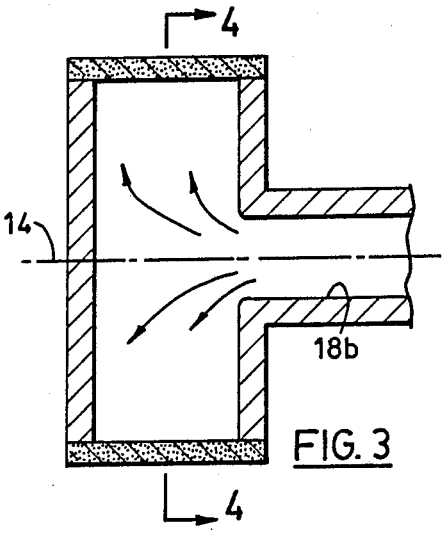
FIG. 3 is a longitudinal section through a second embodiment.

Attention is now directed to FIGS. 3 and 4, which are similar to FIGS. 1 and 2, but are directed to the second embodiment of this invention. In order to avoid repetition, it is not necessary to again identify all parts of the structure. It will be noted that the FIG. 4 section is substantially identical to the FIG. 2 section, but that the section represented in FIG. 3 differs from that represented in FIG. 1 in that the FIG. 3 section cuts through flat, parallel walls. Thus, the section of FIG. 3 is very similar to the prior art section of FIG. 7.

In the embodiment illustrated in FIGS. 3 and 4, the widening takes place only in the transverse plane, which is cut by the section of FIG. 4, and no widening takes place in the longitudinal plane represented by FIG. 3. Nonetheless, as can be seen by referring to the line 48 in FIG. 9, there is again a progressive increase of the cross section of the pocket in the direction away from the axis 14, such that the rate of increase at the outer extremity of the pocket is greater than the rate of increase at the inside. This again is represented by the curved nature of the line 48, with a steeper slope at the right than at the left.

Figure 6:
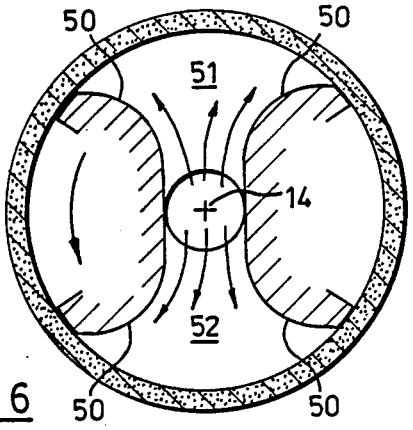
FIG. 6 is a transverse section taken at the line A—A in FIG. 5.
Figure 5:
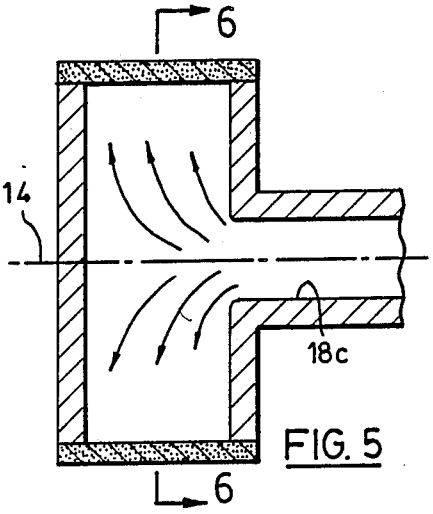
FIG. 5 is a longitudinal section through a third embodiment.

Finally, attention is directed to the third embodiment illustrated in FIG. 5 and 6. It will be noted that the longitudinal section of FIG. 5 is substantially the same as that of FIG. 3 for the second embodiment, but that the transverse section shown in FIG. 6 includes a double flare with two rounded walls 50 for each of the pockets 51 and 52. This more greatly exaggerates the flare, so that the rate at which each pocket widens away from the axis 14 is greater than in either of the two earlier embodiments. This is particularly seen with reference to the line 55 in FIG. 9, which is also labelled "3rd Embodiment.

While three embodiments of this invention have been illustrated in the accompanying drawings and described hereinabove, it will be evident to those skilled in the art that changes and modifications may be made thereto without departing from the essence of this invention, as set forth in the appended claims.

I claim:

1. In a centrifugal grinder having an internal grinding surface shaped as a surface of revolution, and a rotor mounted within said surface for rotation about the axis thereof, the rotor defining a generally axial inlet passageway for material to be ground, and at least one pocket extending generally outwardly from the axis of the rotor toward the grinding surface, the improvement which comprises:

the provision of a configuration for said at least one pocket, wherein the cross-section of said at least one pocket increases at an increasing rate away from the rotor axis, the differential of the expansion rate of the cross-section of said at least one pocket at its outer limit adjacent the internal grinding surface being at least 8 times as great as the differential of the expansion rate of the cross-section of said at least one pocket at the level corresponding to the surface of the said generally axial inlet passageway.

2. The invention claimed in claim 1, in which the said cross-section of said at least one pocket widens progressively away from said axis when seen ina cross-sectional plane transverse to the rotor axis.

3. The invention claimed in claim 2, in which the said cross-section of said at least one pocket also widens progressively away from said axis when seen in a longitudinal plane containing both said rotor axis and the pocket.

4. The invention claim in claim 3, in which there are two pockets at a spacing of 180°.

5. The invention claimed in claim 2, in which the pocket is bi-laterally symmetrical about a mid-longitudinal plane containing said rotor axis.

6. The invention claimed in claim 5, in which there are two pockets at a spacing of 180 .

7. The invention claimed in claim 2, in which there are two pockets at a spacing of 180°.

8. The invention claimed in claim 1, in which there are two pockets at a spacing of 180°.

9. A centrifugal grinder having an internal grinding surface shaped as a surface of revolution, and a rotor mounting within said surface for rotation about the axis thereof, the rotor defining a generally axial inlet passageway for material to be ground, and at least one pocket extending generally outwardly from the axis of the rotor toward the grinding surface, said at least one pocket having a cross-section which increases at an increasing rate away from the rotor axis, the differential of the expansion rate of the cross-section of said at least one pocket at its outer limit adjacent the internal grinding surface being at leaset 8 times as great as the differential of the expansion rate of the cross-section of said at least one pocket at the

10. The invention claimed in claim 9, in which the said at least one pocket widens progressively away from said axis when seen in a cross-sectional plane transverse to the rotor axis.

11. The invention claimed in claim 10, in which the said at least one pocket also widens progressively away from said axis when seen in a longtiduinal plane containing both said rotor axis and the pocket.

12. The invention claimed in claim 10, in which the pocket is bi-laterally symmetrical about a mid-longitudinal plane containing said rotor axis.

13. The invention claimed in claim 9, in which there are two pockets at a spacing of 180°.

* * * * *